US009042518B2

(12) United States Patent
Fürst et al.

(10) Patent No.: US 9,042,518 B2
(45) Date of Patent: May 26, 2015

(54) ASYNCHRONOUS OPERATION OF A ROTARY ANODE WITH REDUCED FOCAL SPOT SHAKE

(71) Applicants: Jens Fürst, Herzogenaurach (DE); Andreas Körner, Elsendorf (DE); Johannes Walk, Buckenhof (DE)

(72) Inventors: Jens Fürst, Herzogenaurach (DE); Andreas Körner, Elsendorf (DE); Johannes Walk, Buckenhof (DE)

(73) Assignee: Siemens Aktiengesellschaft, München (DE)

( * ) Notice: Subject to any disclaimer, the term of this patent is extended or adjusted under 35 U.S.C. 154(b) by 114 days.

(21) Appl. No.: 13/957,378

(22) Filed: Aug. 1, 2013

(65) Prior Publication Data

US 2014/0037067 A1 Feb. 6, 2014

(30) Foreign Application Priority Data

Aug. 1, 2012 (DE) ..... 10 2012 213 605

(51) Int. Cl.
*H05G 1/66* (2006.01)
*H05G 1/30* (2006.01)
*H01J 35/26* (2006.01)

(52) U.S. Cl.
CPC . *H05G 1/30* (2013.01); *H01J 35/26* (2013.01)

(58) Field of Classification Search
CPC ..... H05G 1/34; H05G 1/08; H01J 35/10; H01J 35/08; H01J 35/26
USPC ..... 378/93, 121, 125, 143, 144
See application file for complete search history.

(56) References Cited

U.S. PATENT DOCUMENTS

2009/0154649 A1 6/2009 Behling
2011/0235784 A1* 9/2011 Behling ..... 378/125

FOREIGN PATENT DOCUMENTS

DE 3217900 C2 6/1987
DE 102011005115 9/2012
DE 102012204841 10/2013
WO 9950882 10/1999

OTHER PUBLICATIONS

German Office Action dated Apr. 2, 2013 for corresponding German Patent Application No. DE 10 2012 213 605.3 with English translation.

* cited by examiner

*Primary Examiner* — Courtney Thomas
(74) *Attorney, Agent, or Firm* — Lempia Summerfield Katz LLC

(57) ABSTRACT

A method for asynchronous operation of a rotary anode of an x-ray emitter, where a torque is exerted onto the rotary anode by an electromagnetic alternating field of a stator with a first frequency is provided. The method includes increasing the first frequency to a second frequency. The second frequency is a whole number multiple of an x-ray trigger frequency. The method also includes simultaneously changing an output of the alternating field such that a rotational frequency of the rotary anode remains unchanged.

20 Claims, 3 Drawing Sheets

ASYNCHRONOUS OPERATION OF A ROTARY ANODE WITH REDUCED FOCAL SPOT SHAKE

This application claims the benefit of DE 10 2012 213 605.3, filed on Aug. 1, 2012.

FIELD

The present embodiments relate to asynchronous operation of a rotary anode of an x-ray emitter.

BACKGROUND

With medical x-ray imaging, x-ray tubes with rotary anodes are used to generate x-ray radiation. A plate-shaped rotary anode is accelerated to a high rotational frequency and is rotated away from electrons generated in a cathode (e.g., a "focal spot" at the point of incidence). The more quickly the rotary anode moves below the electron beam, the higher the possible surface loading of the focal spot. In order to improve the image quality of the x-ray imaging, there is the possibility of increasing the pulsed power of the x-ray tube or reducing the focal spot. With modern rotary anode x-ray tubes, the rotary anode rotates at approximately 150 Hz to 200 Hz. Accordingly, a powerful anode drive is provided in order to accelerate the mass of the rotary anode of several kilograms.

FIG. 1 shows a cross-section through an x-ray emitter 1 with an x-ray tube 2 and a rotary anode 3. A stator 6 outside of the vacuum vessel of the x-ray tube 2 but inside of the housing 10 of the x-ray emitter 1 generates an electromagnetic alternating field. The rotor 5 is disposed on a shaft 12 of the rotary anode 3. The rotor is made to rotate by the alternating field of the stator 6. A cathode 4 (e.g., an incandescent cathode with a Wehnelt cylinder) generates an electron beam 11 that is accelerated to the rotary anode 3. At the point of incidence on the rotary anode 3, the electron beam 11 is braked, and as a result, x-ray radiation 9 is generated. The generated x-ray radiation 9 leaves the x-ray emitter 1 through a beam exit window 7 of the housing 10 in order to be shaped by a diaphragm 8, for example.

The stator 6 may be operated with alternating current and consumes some kW of electrical power. The strong electromagnetic alternating field of the stator 6 has a disruptive influence on the trajectory of the electrons of the electron beam 11, since the electrons are deflected by the alternating field such that the focusing on the rotary anode 3 is disturbed. This results in a movement to and from the focal spot in time with the frequency of the alternating field of the rotary anode drive. This modulation of the focus point is noticeable in an x-ray image generated by x-ray radiation from a shake of the image edges. This unwelcome effect is referred to among persons skilled in the art as "focus shake".

There are a number of known possibilities of reducing the focus shake at least partially. For example, a Mu metal shielding may be applied between the stator and the rear of the rotary anode, for example. Mu metal is a magnetically-soft nickel-iron alloy and has the property of shielding electromagnetic fields. Since the focusing of the electrons on the rotary anode is realized by coils, the electron path and thus the focusing may also be influenced by changing the electromagnetic field. This method is very expensive.

Another possibility includes synchronizing the stator with the image frequency. If, for example, a recording takes place with 30 images per second, the stator may be supplied with eight times 30 Hz of alternating current (i.e., 240 Hz). As a result, the drive phase is the same as each recording, and a focus shake may be minimized. However, this solution produces interfering noise during operation of the x-ray emitter.

A further solution is specified in patent application DE 10 2012 204 841 A1. A rotary anode x-ray emitter having an x-ray tube for generating x-ray radiation is specified in order to generate x-ray radiation. The x-ray emitter includes a rotary anode having a rotary axis and arranged in a vacuum vessel, a rotor arranged on the axis of rotation, and a stator that is arranged partially outside of the vacuum vessel. The stator generates an electromagnetic alternating field for driving the rotor. The stator includes at least one stator coil for generating the electromagnetic alternating field. The x-ray emitter further includes a cathode for generating an electron beam accelerated to the rotary anode. At least one counter coil for compensating for the electromagnetic alternating field of the stator coil is arranged in the region of the cathode or of the electron beam.

SUMMARY AND DESCRIPTION

The scope of the present invention is defined solely by the appended claims and is not affected to any degree by the statements within this summary.

Electrical alternating current with a variable frequency to power stator coils may be provided by a frequency converter. The frequency converter is an inverter that, from alternating voltage, generates an alternating voltage that may be changed in terms of frequency and amplitude in order to power rotary current motors directly. The criterion for the frequency and amplitude with which the output alternating voltage is generated is geared, for example, to the requirements of the electrical machine (e.g., to current mechanical load) and is varied as a function of the frequency converter. Depending on the type of electrical machine, frequency converters may be operated both with a single phase alternating voltage and also with a three phase alternating voltage and may generate a three phase alternating voltage to power three-phase motors from the single phase alternating voltage. Some frequency converters include additional sensor inputs so as to detect status parameters of the electrical machine, such as rotational speed or current angular position of the rotor.

In FIG. 2, the functional principle of a frequency converter 18 is shown with the aid of a block diagram and the voltage curves. A three-phase input voltage U1 is rectified by a rectifier 13 and is kept stable in terms of voltage with a capacitor of an intermediate circuit 14. The intermediate circuit voltage U2, which amounts to approximately 1.35-times the input voltage U1, develops at the output of the intermediate circuit. The curve of the input voltage U1 over time t for the three phases is shown to the left below the block diagram. The curve of the intermediate circuit voltage U2 is also shown.

The intermediate circuit voltage U2 is converted by an inverter 15 into a motor voltage U3 with a clocked, periodic form. The method is based on the sinusoidal pulse width modulation. The configuration of the clocked motor voltage U3 is dependent on the desired output frequency. The motor voltage U3 is shown as a function of time t in the diagram to the right below the block diagram. Different pulse widths are clearly shown. With the aid of a Fourier analysis, the clocked motor voltage U3 of the frequency converter 18 may show the same effect on the electric motor 16 as a sinusoidal voltage with the same amplitude and frequency. Generation of the rotary field of the motor is controlled by control electronics 17.

The present embodiments may obviate one or more of the drawbacks or limitations in the related art. For example, a method and an apparatus that prevent focus shake when generating x-ray radiation are provided.

The rotational frequency of the rotary anode is kept constant despite increasing the motor drive frequency by the slip between the rotor and the stator being increased.

A method for the asynchronous operation of a rotary anode of an x-ray emitter, onto which a torque is exerted by an electromagnetic alternating field of a stator with a first frequency, is provided. The frequency of the alternating field is increased to a second frequency. The second frequency is a whole number multiple of an x-ray trigger frequency. At the same time, an output of the alternating field is changed such that the rotational frequency of the rotary anode does not change. One or more of the present embodiments are advantageous in that the frequency of the alternating field may be increased without additional forces on the rotary anode.

In one embodiment, a stator voltage on the stator for generating the electromagnetic alternating field may be pulse-width modulated.

In a further embodiment, the output may be reduced. The pulse width of the stator voltage is changed.

The increase in the first frequency and the simultaneous change in the output of the alternating field may advantageously only take place upon an x-ray trigger.

The first frequency and the second frequency may be 220 Hz and 240 Hz, respectively. The rotational frequency of the rotary anode is 200 Hz.

In one embodiment, an x-ray emitter arrangement is provided. The x-ray emitter arrangement includes an x-ray tube for generating x-ray radiation, a rotary anode that is arranged so as to be rotatable in the x-ray tube, and a stator that generates an electromagnetic alternating field with a first frequency for driving the rotary anode. The arrangement includes a frequency converter that delivers a stator voltage with the first frequency for generating the electromagnetic alternating field. The frequency converter increases the first frequency to a second frequency. The second frequency is a whole number multiple of an x-ray trigger frequency. The frequency converter, at the same time, changes the stator voltage such that the rotational frequency of the rotary anode remains unchanged.

In a further embodiment, the stator voltage may be pulse width-modulated.

In a development of the arrangement, the frequency changer may change the pulse width of the stator voltage.

In a further embodiment, the first frequency may be increased, and the modulation of the stator voltage may be changed only with an x-ray trigger.

Further specific features and advantages will be apparent from the following explanations of exemplary embodiments with reference to schematic drawings.

DETAILED DESCRIPTION

Figure 1:
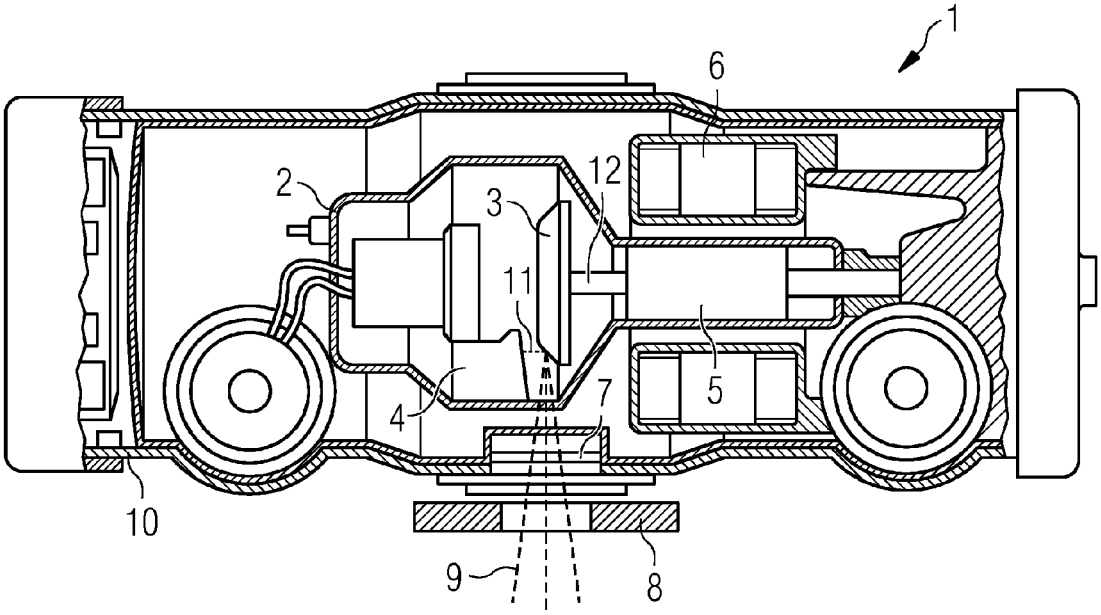
FIG 1 Prior Art
FIG. 1 shows a cross-section through an x-ray emitter according to the prior art.
Figure 2:
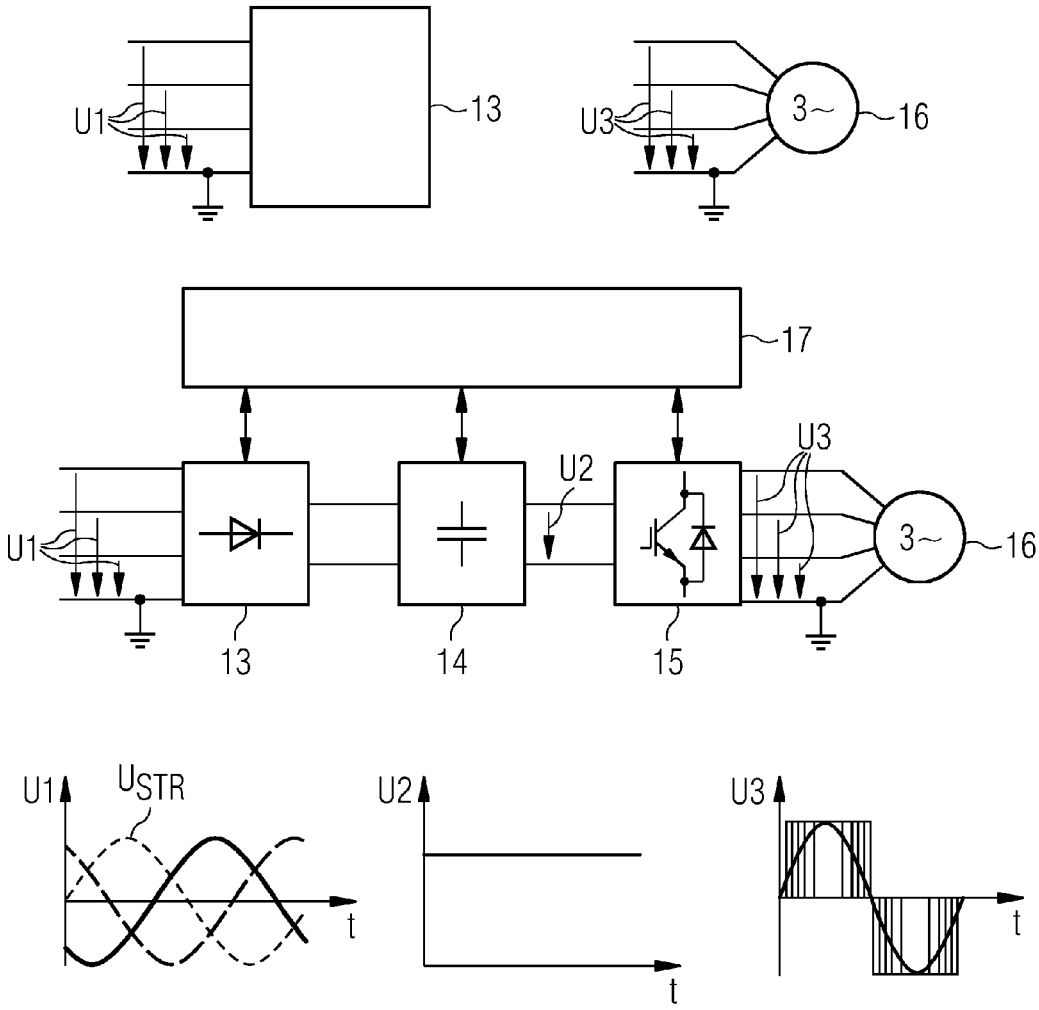
FIG. 2 shows a block diagram of a frequency converter.
Figure 3:
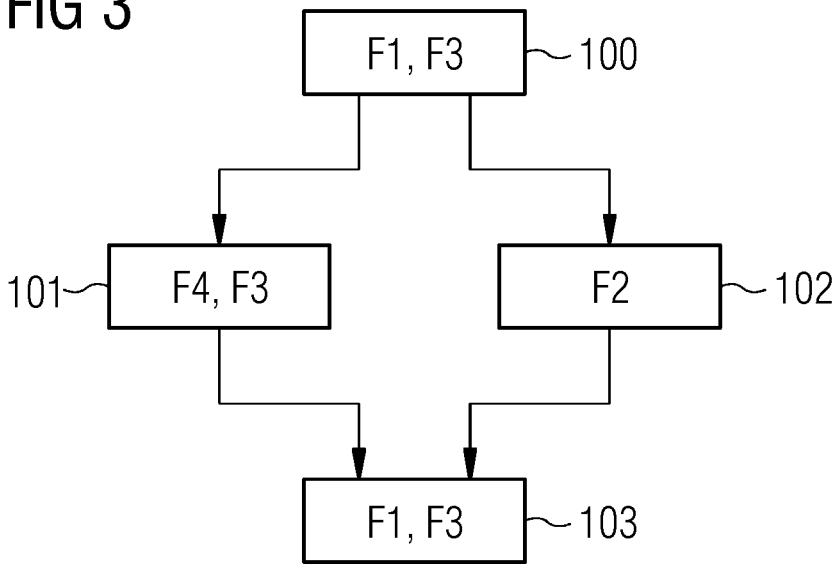
FIG. 3 shows a flow diagram of one embodiment of a method for operating a rotary anode.

FIG. 3 shows a flow diagram of one embodiment of a method for operating a rotary anode with acts 100 to 103. In act 100, the rotary anode is rotated with a rotational frequency F3 of, for example, 200 Hz. An electromagnetic alternating field of a stator powering the rotary anode is pulsed with a first frequency F1 of, for example, 220 Hz. A large slip between the rotational frequency F3 and the first frequency F1 is produced on account of a large air gap between the rotor of the rotary anode and the stator.

In act 101, an x-ray radiation is triggered with a trigger frequency F4 of 30 Hz. In act 102, which proceeds at the same time, the frequency of the alternating field is increased to a second frequency F2 of, for example, 240 Hz, which is a whole number multiple of a trigger frequency F4 (e.g., F2=8*F4). A focus shake is thus prevented. To provide that the rotary anode does not have to be accelerated to a higher rotational frequency F3, the output of the alternating field is reduced. This takes place, for example, by changing the modulation of a motor voltage U3. The rotational frequency F3 remains constant at 200 Hz, as only the drive frequency of the stator increases. The slip of the asynchronous drive increases.

In act 103, when concluding the x-ray image recording, the drive frequency is moved back to the first frequency F1, and the changed modulation of the motor voltage U3 is raised again. The output is thus increased again, and the slip reduces.

Alternatively, the slip may be permanently increased irrespective of an x-ray image recording. The drive frequency is a multiple of the x-ray trigger frequency and is, for example, approximately 40 Hz higher than the rotational frequency of the rotary anode.

Figure 4:
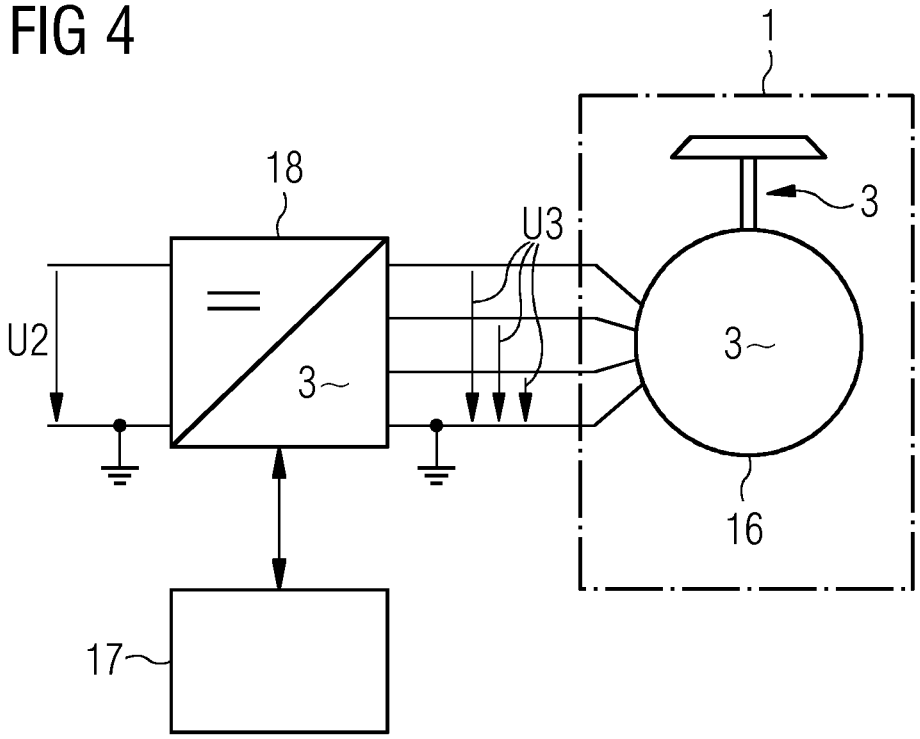
FIG. 4 shows a block diagram of one embodiment of an x-ray tube arrangement with a rotary anode.

FIG. 4 shows a block diagram of one embodiment of an x-ray emitter arrangement having an x-ray tube 2 for generating an x-ray radiation and having a rotary anode 3 that is arranged so as to be rotatable in the x-ray tube 2. A stator 6 generates an electromagnetic alternating field with a first frequency F1 for driving the rotary anode 3 using a rotor 5.

A frequency converter 18 generates a stator voltage U3 from a rectified intermediate circuit voltage U2. The stator voltage U3 has the first frequency F1 for generating the electromagnetic alternating field. In accordance with one or more of the present embodiments, the frequency converter 18 increases the first frequency F1 to a second frequency F2 at a start of an x-ray image acquisition. The second frequency F2 is a whole number multiple of an x-ray trigger frequency F4. At the same time, the frequency converter 18 changes the stator voltage U3 such that the rotational frequency F3 of the rotary anode remains unchanged. This may takes place by changing the pulse width of the pulse width-modulated stator voltage U3. The frequency converter 18 is activated by control electronics 17.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A method for asynchronous operation of a rotary anode of an x-ray emitter, onto which a torque is exerted by an electromagnetic alternating field of a stator with a first frequency, the method comprising:

increasing the first frequency to a second frequency, wherein the second frequency is a whole number multiple of an x-ray beam trigger frequency; and simultaneously changing an output of the electromagnetic alternating field such that a rotational frequency of the rotary anode remains unchanged.

2. The method as claimed in claim 1, further comprising pulse width-modulating a stator voltage at the stator for generating the electromagnetic alternating field.

3. The method as claimed in claim 1, wherein the output is reduced.

4. The method as claimed in claim 2, wherein a pulse width of the stator voltage is changed.

5. The method as claimed in claim 1, wherein the increasing and the simultaneous changing only take place upon an x-ray trigger.

6. The method as claimed in claim 1, wherein the first frequency is 220 Hz, and the second frequency is 240 Hz, and wherein the rotational frequency of the rotary anode is 200 Hz.

7. The method as claimed in claim 2, wherein the output is reduced.

8. The method as claimed in claim 3, wherein a pulse width of the stator voltage is changed.

9. The method as claimed in claim 2, wherein the increasing and the simultaneous changing only take place upon an x-ray trigger.

10. The method as claimed in claim 4, wherein the increasing and the simultaneous changing only take place upon an x-ray trigger.

11. The method as claimed in claim 2, wherein the first frequency is 220 Hz, and the second frequency is 240 Hz, and wherein the rotational frequency of the rotary anode is 200 Hz.

12. The method as claimed in claim 5, wherein the first frequency is 220 Hz, and the second frequency is 240 Hz, and wherein the rotational frequency of the rotary anode is 200 Hz.

13. An x-ray emitter arrangement comprising:

an x-ray tube operable to generate x-ray radiation;

a rotary anode arranged so as to be rotatable in the x-ray tube;

a stator operable to generate an electromagnetic alternating field with a first frequency for driving the rotary anode; and a frequency converter configured to:

deliver a stator voltage with the first frequency for generating the electromagnetic alternating field;

increase the first frequency to a second frequency, wherein the second frequency is a whole number multiple of an x-ray beam trigger frequency; and simultaneously change the stator voltage such that a rotational frequency of the rotary anode remains unchanged.

14. The x-ray emitter arrangement as claimed in claim 13, wherein the stator voltage is pulse width-modulated.

15. The x-ray emitter arrangement as claimed in claim 14, wherein the frequency converter is operable to change a pulse width of the stator voltage.

16. The x-ray emitter arrangement as claimed in claim 13, wherein the stator voltage comprises the second frequency, and the modulation of the stator voltage is changed only upon an x-ray trigger.

17. The x-ray emitter arrangement as claimed in claim 13, wherein the first frequency is 220 Hz, and the second frequency is 240 Hz, and wherein the rotational frequency of the rotary anode is 200 Hz.

18. The x-ray emitter arrangement as claimed in claim 14, wherein the stator voltage comprises the second frequency, and the modulation of the stator voltage is changed only upon an x-ray trigger.

19. The x-ray emitter arrangement as claimed in claim 15, wherein the stator voltage comprises the second frequency, and the modulation of the stator voltage is changed only upon an x-ray trigger.

20. The x-ray emitter arrangement as claimed in claim 15, wherein the first frequency is 220 Hz, and the second frequency is 240 Hz, and wherein the rotational frequency of the rotary anode is 200 Hz.

* * * * *